US011540586B2

(12) United States Patent
Mazzarolo et al.

(10) Patent No.: US 11,540,586 B2
(45) Date of Patent: Jan. 3, 2023

(54) PROTECTIVE HELMET

(71) Applicant: Alpinestars Research S.p.A., Maser (IT)

(72) Inventors: Giovanni Mazzarolo, Coste di Maser (IT); Roberto Parissenti, Sedico Belluno (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 79 days.

(21) Appl. No.: 16/646,877

(22) PCT Filed: Sep. 14, 2018

(86) PCT No.: PCT/EP2018/074868

§ 371 (c)(1),
(2) Date: Mar. 12, 2020

(87) PCT Pub. No.: WO2019/053183

PCT Pub. Date: Mar. 21, 2019

(65) Prior Publication Data

US 2020/0275725 A1 Sep. 3, 2020

(30) Foreign Application Priority Data

Sep. 15, 2017 (IT) ..... 102017000103682

(51) Int. Cl.
*A42B 3/22* (2006.01)
*A42B 3/32* (2006.01)

(52) U.S. Cl.
CPC ..... *A42B 3/221* (2013.01); *A42B 3/227* (2013.01); *A42B 3/32* (2013.01)

(58) Field of Classification Search
CPC ..... A42B 3/221; A42B 3/227; A42B 3/328; A42B 3/322; A42B 3/32
See application file for complete search history.

(56) References Cited

U.S. PATENT DOCUMENTS 3,239,842 A 3/1966 Marchello
6,009,561 A * 1/2000 Bullock ..... A42B 3/227 24/297

(Continued)

FOREIGN PATENT DOCUMENTS

CN 105917125 A 8/2016
DE 1790999 U 6/1959

(Continued)

OTHER PUBLICATIONS

PCT International Search Report and Written Opinion dated Feb. 11, 2019 for Intl. App. No. PCT/EP2018/074868, from which the instant application is based, 10 pgs.

*Primary Examiner* — Khoa D Huynh
*Assistant Examiner* — Erick I Lopez
(74) *Attorney, Agent, or Firm* — Fredrikson & Byron, P.A.

(57) ABSTRACT

The present invention relates to a protective helmet (10) comprising an outer shell (12) and a visor (14) removably coupled to the outer shell (12) by means of a fastening mechanism (20) positioned on facing surfaces of the shell (12) and the visor (14). According to the invention the fastening mechanism (20) comprises complementarily shaped elements (22, 24) comprising at least one protrusion (22) and at least one receiving seat (24) provided with a flexible holding portion (26). The at least one protrusion (22) is adapted to be removably fixed inside the at least one receiving seat (24) by engaging the flexible holding portion (26).

17 Claims, 12 Drawing Sheets

(56) References Cited

U.S. PATENT DOCUMENTS

| | | | | |
|---|---|---|---|---|
| 6,718,559 | B1 | 4/2004 | Davidson | |
| 2014/0189939 | A1* | 7/2014 | Cheng | A42B 3/227 2/422 |
| 2017/0367425 | A1* | 12/2017 | Chen | A42B 3/046 |

FOREIGN PATENT DOCUMENTS

| | | | |
|---|---|---|---|
| EP | 2759219 | A1 | 7/2014 |
| SE | 1550628 | A1 | 11/2016 |
| WO | 2012047936 | A2 | 4/2012 |

* cited by examiner

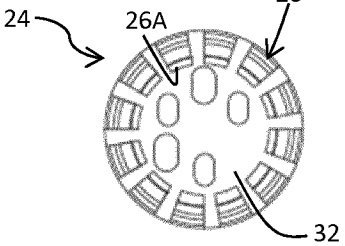
Fig. 4
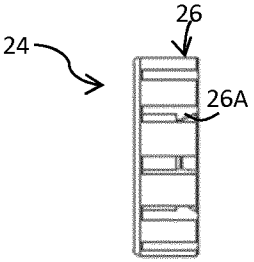
Fig. 5
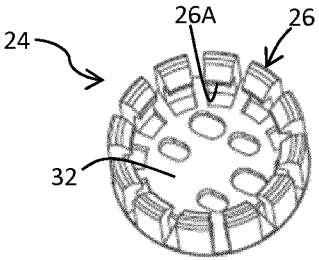
Fig. 6
Fig. 7
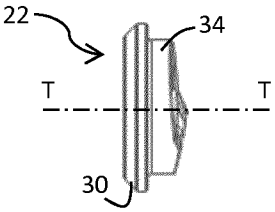
Fig. 8
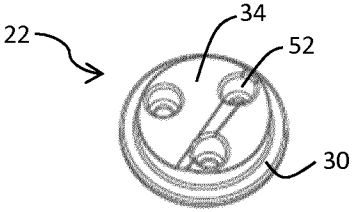
Fig. 9

PROTECTIVE HELMET

RELATED APPLICATIONS

This application is a 35 U.S.C. 371 national stage filing from International Application No. PCT/EP2018/074868, filed Sep. 14, 2018, which claims priority to Italian application No. 102017000103682, filed Sep. 15, 2017, the teachings of which are incorporated herein by reference.

The present invention relates to a protective helmet. In particular, the present invention refers, even if in a non-exclusive way, to a protective helmet suitable for being used in motor sports, like motocross.

This kind of helmets generally comprises a shell, having a dome shaped structure designed to protect the user's head, the shell being provided with an opening at the front.

Usually motocross helmets are also provided with a visor, positioned close to the front opening and projecting from the shell. The visor has the function to protect the user from flying debris during off-road riding and to reduce the sun glare.

Generally the visor is coupled at both the sides and the front of the shell by means of mechanical fasteners such as snaps, straps or screws.

While the side fasteners allow the visor to be firmly affixed to the helmet, the central fastener has also the function to allow the visor to be raised or lowered with respect of the rider's eyes.

It is known to use screws made with thermoplastic material and having frangible shape to connect the visor to the shell. However, by using this kind of screws the visor is too strongly coupled to the shell and during an impact it will not easily detach off the shell.

This occurrence can create potential risk to the user due to the fact that the visor protrudes from the shell and it can hit the ground causing undesired rotations of the helmet.

The helmet rotation may provoke serious brain damage and eventually cause spinal issues, with lethal consequences in the worst case.

Moreover, in "real conditions" the detaching force, acting on the attachment area between visor and shell during an impact, can be broken down in a tangential component and in a normal component. In case the visor is fixed to the shell by means of frangible screws only the tangential component of the detaching force is effective in detaching the visor from the shell. As a matter of fact, the shearing force created by the tangential component permits to break the screws. In other words the visor "cuts" the screws.

Consequently the normal component of the impact force is less effective in detaching the visor from the shell.

Conversely, in case the visor is fixed to the shell by means of snap fasteners, as disclosed for example in EP2759219 and U.S. Pat. No. 6,009,561, only the normal component of the detaching force is effective in detaching the visor from the shell.

Therefore, in both cases, the direction on which the detaching force acts affects the detaching of the visor from the shell with serious risks for the user.

It is also known to use a visor made from not rigid thermoplastic material, for example injected polypropylene. In this case, the visor may bend in the event of a collision, thus reducing rotational acceleration.

However, even if the visor is made with not rigid material, the geometry thereof might be so complex that the flexibility of the visor is reduced and the risk of undesired rotations remains high.

It is also known to affix the visor to the shell by means of magnetic elements applied on facing portions of the shell and of the visor.

The magnetic fastener means allow an easier detachment of the visor from the shell in case of an accident. However, in case the visor is hit by flying debris, the risk that the visor might be unintentionally detached from the shell is higher.

Furthermore, in some cases a gap is created between the outer surface of the shell and the inner surface of the visor when the visor is affixed to the shell. This gap may increase the helmet rotational force during a collision.

The object of the present invention is to provide a protective helmet having a visor which solves at least partly the above mentioned problems and drawbacks.

In particular, an aim of the present invention is to provide a protective helmet having a visor firmly affixed to the shell during normal use and suitable for being easily detached in case of an impact, so as to reduce undesired rotations of the helmet.

Moreover, an aim of the present invention is to provide a protective helmet having a visor which can be easily detached from the shell, for instance to carry on helmet maintenance and cleaning.

Another aim of the present invention is to provide a protective helmet having a visor which can be positioned flush over the shell.

Furthermore, an aim of the present invention is to provide a protective helmet having a visor which can be easily detached from the shell independently from the direction along which the detaching force is applied.

Moreover, an aim of the present invention is to provide a protective helmet having a visor which, after being detached from the shell following a collision, might be easily re-connected to the shell, in case no structural damage is observed.

Finally, another aim of the present invention is to provide a protective helmet having a visor which can be easily adjusted with respect to the rider's eyes.

These and other objects and aims are achieved by the protective helmet according to claim 1.

The advantages and the characteristic features of the invention will appear more clearly from the following description of a preferred, but not exclusive, embodiment of the protective helmet with reference to the accompanying figures in which:

FIGS. 4, 5 and 6 are respectively a front, a side and a perspective view of a fastening element used in the helmet of FIG. 1 to couple the visor to the shell;

FIGS. 7, 8 and 9 are respectively a bottom, a side and a perspective view of a complementary element of the fastening element shown in FIGS. 4, 5 and 6;

With reference to the attached figures, an example of a protective helmet according to the invention is indicated as a whole by the reference 10. Said protective helmet 10 is suitable for being used in particular by motocross riders. Nevertheless, as it will appear more clearly from the following description, the protective helmet 10 can also be advantageously used by cyclists, skiers or in other fields where an effective protection of the user's head must be obtained.

Figure 1:
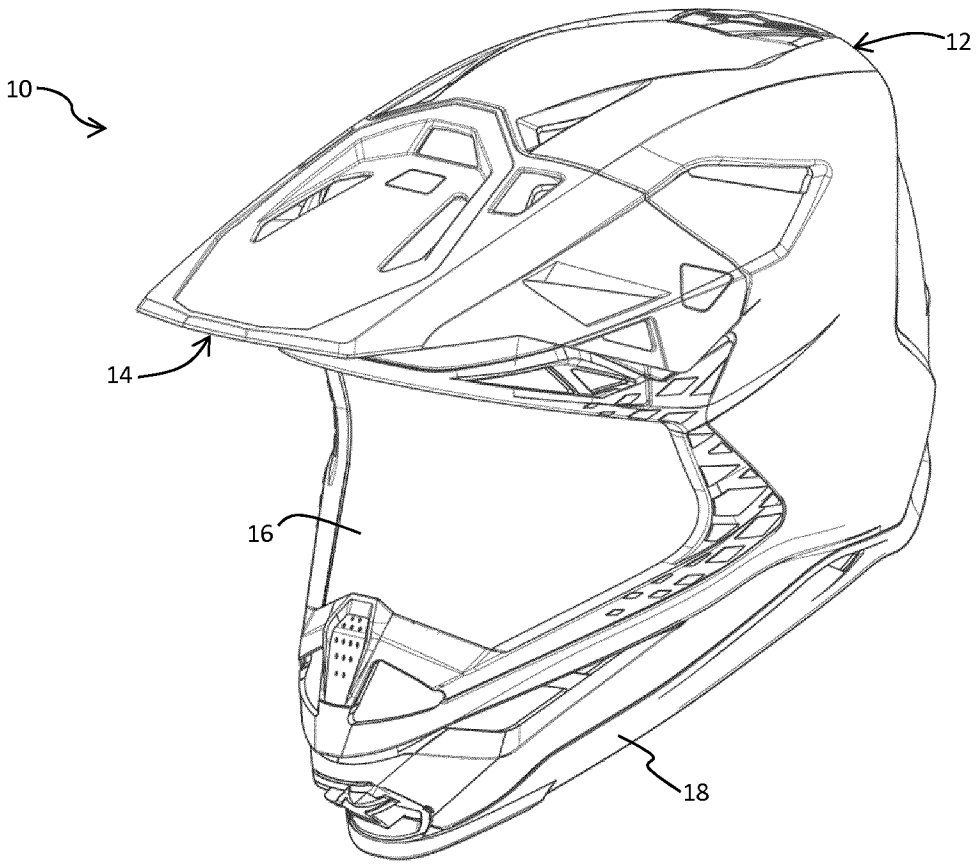
FIG. 1 shows a perspective view of a protective helmet according to the present invention.

As shown in FIG. 1, the protective helmet 10 comprises an outer shell 12, which is preferably made of rigid material and dome shaped so as to fit over the user's head, and a visor 14, preferably made of rigid material, which is designed to be removably coupled to the outer shell 12. The visor 14 is preferably coupled to the outer shell 12 so as to project above a front opening 16 of the outer shell 12.

In FIG. 1, a protective helmet 10, provided with a chin guard 18, is shown. However, the teachings of the present invention can also be advantageously applied to the so-called "open-face helmets".

The visor 14 is removably coupled to the outer shell 12 by means of a fastening mechanism 20.

Figure 2:
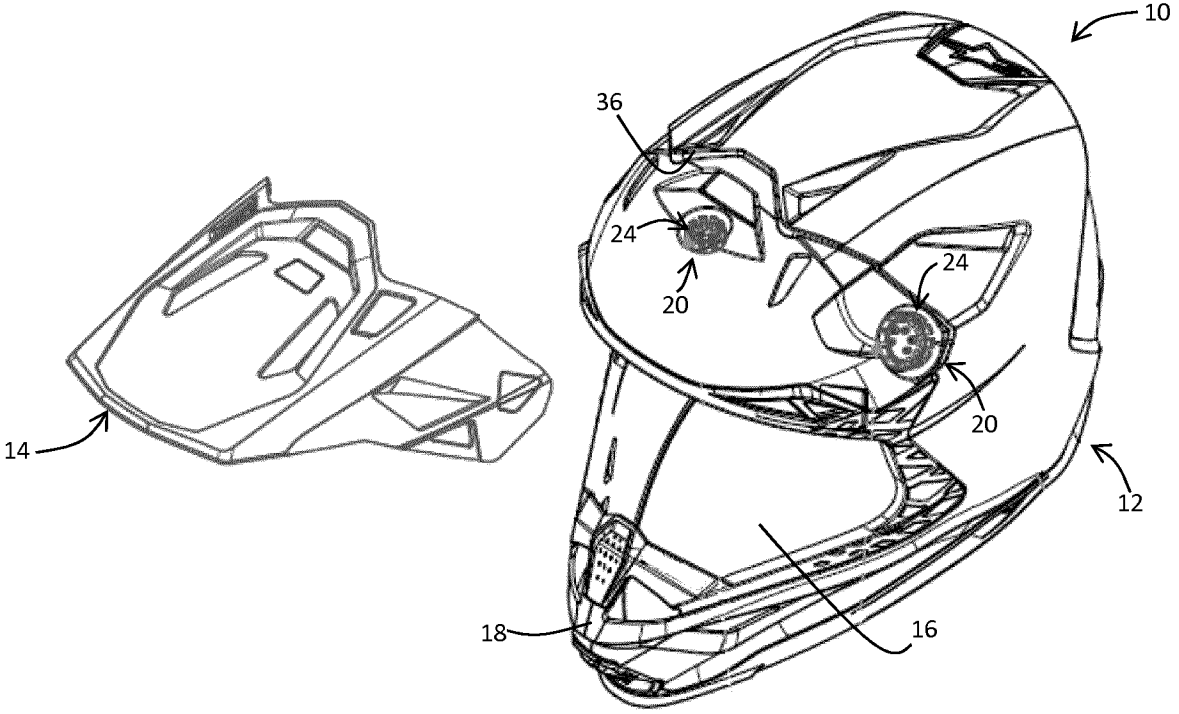
FIG. 2 shows a view similar to FIG. 1, wherein the visor is detached from the shell.
Figure 3:
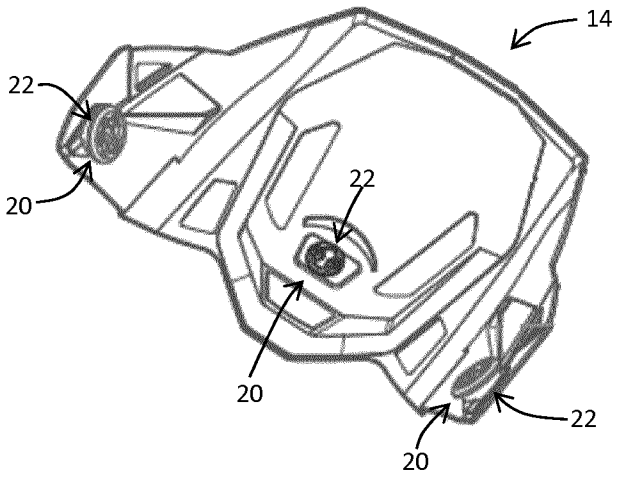
FIG. 3 shows a bottom perspective view of the visor of FIG. 2.

As shown in FIGS. 2 and 3, the fastening mechanism 20 is positioned on facing surfaces of the outer shell 12 and the visor 14.

According to the invention, the fastening mechanism 20 comprises complementarily shaped elements 22, 24 which comprise a protrusion 22 (see FIGS. 7-9) and a receiving seat 24, which is provided with a flexible holding portion 26 (see FIGS. 4-6).

In the following description, as "flexible holding portion" there will be indicated a holding portion that is able to be deformed when a force is applied thereto and which will return to its original shape when the force is removed.

Figure 14:
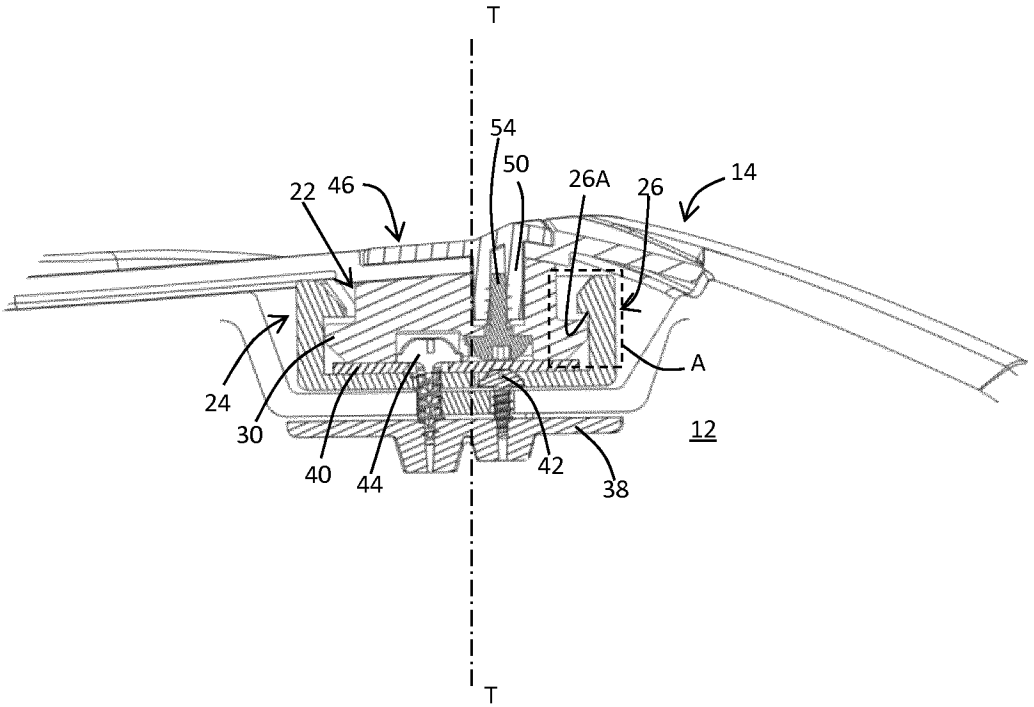
FIG. 14 shows a schematic cross-section of the fastening element of FIGS. 4, 5 and 6 when it is coupled to the complementary element of FIGS. 7, 8 and 9.

As shown in FIG. 14, the protrusion 22 is adapted to be removably fixed inside the receiving seat 24 by engaging the flexible holding portion 26.

Preferably, as shown in FIGS. 1-3, two protrusions 22 are positioned at the inner side ends of the visor 14 and two receiving seats 24 are positioned at corresponding locations of the outer shell 12.

Advantageously, a third receiving seat 24 can be positioned along a midline of the outer shell 12 and a third protrusion 22 can be positioned at a corresponding location on the inner surface of the visor 14.

Alternatively, the receiving seats 24 can be provided on the visor 14 and the protrusions 22 can be positioned on corresponding locations of the outer shell 12.

Figure 10:
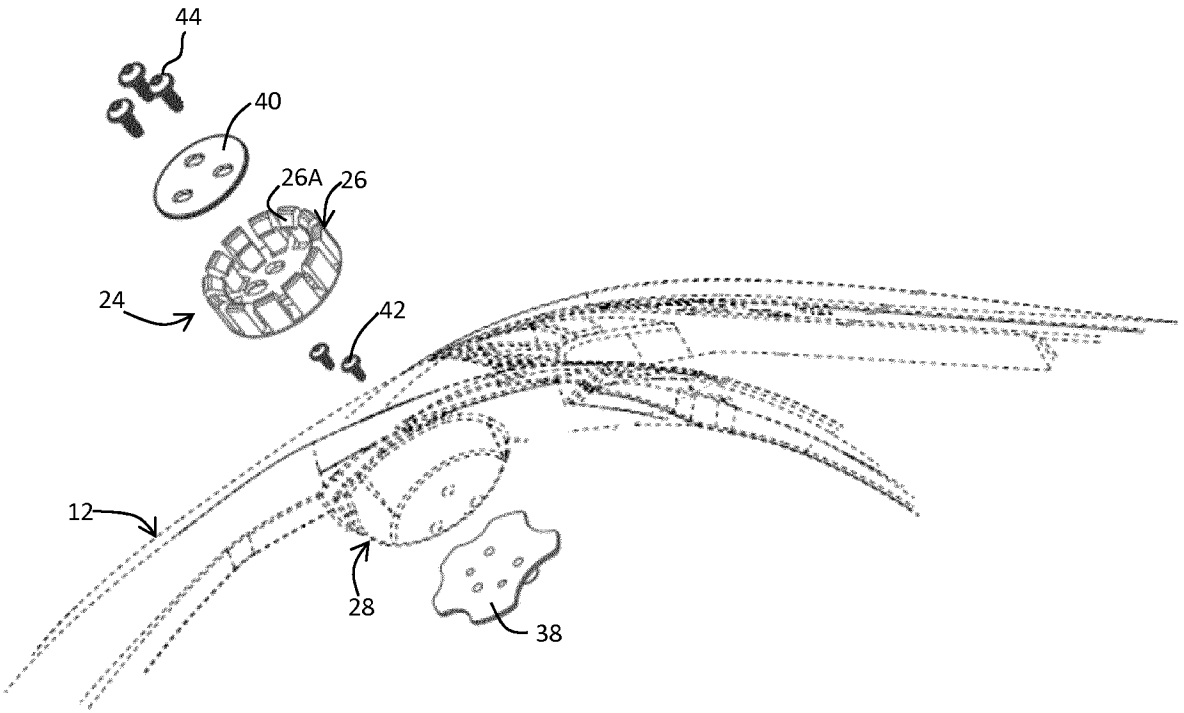
FIG. 10 is a schematic perspective view showing how the fastening element of FIGS. 4, 5 and 6 can be attached to the shell of the helmet of the present invention.

As shown in FIG. 10, each receiving seat 24 is preferably provided on a recessed area 28 of the outer shell 12.

Advantageously, the receiving seat 24 can be inserted inside the recessed area 28 so as to be positioned flush with the outer shell 12.

Preferably, the receiving seat 24 is removably inserted inside the recessed area 28.

As anticipated, each receiving seat 24 is provided with a flexible holding portion 26.

With reference to FIGS. 4-9, the flexible holding portion 26 preferably comprises one or more flexible arms having hook shaped distal ends 26*a*, suitable for enclosing and hooking a perimetral portion 30 of the corresponding protrusion 22.

Advantageously, the receiving seat 24 comprises a hollow body 32 and the flexible arms 26 are preferably provided at the perimetral portion of the hollow body 32.

As shown in FIGS. 4-6, the hollow body 32 preferably has a circular shape. In this case, the flexible arms 26 substantially form a holding ring.

Advantageously, the protrusion 22 is adapted to be inserted inside the hollow body 32 so that the flexible arms 26 engage the perimetral portion 30 of the protrusion 22 blocking the protrusion 22 inside the receiving seat 24.

In this way, the holding action exerted by the flexible arms along the perimetral portion 30 of the protrusion 22 is suitable to keep the visor 14 firmly coupled to the outer shell 12 (see FIG. 14).

At the same time, by exerting a pull action on the visor 14, the perimetral portion 30 of the protrusion 22 is suitable to space apart the flexible arms 26 so as to allow an easy disengagement of the protrusion 22 from the receiving seat 24 wherein it is fitted, and thus allowing the removal of the visor 14 from the outer shell 12.

According to the embodiment shown in FIGS. 7-9, the protrusion 22 has a circular shape adapted to be inserted inside a receiving seat having a circular shape hollow body 32.

In this embodiment, the flexible arms 26, after the insertion of the protrusion 22 inside the hollow body 32, encircle the perimetral portion of the protrusion 22. The holding force exerted by the receiving seat 24 is substantially divided equally between the various flexible arms 26. Advantageously, due to the positioning of the flexible arms 26 all around the protrusion 22, in case of collision, the detaching of the visor 14 from the shell 12 will not be affected by the direction on which the detaching force acts.

As a matter of fact, both the components of the detaching force, namely the tangential component and the normal component, will be effective in releasing the visor from the shell.

In other words, it is not requested that the detaching force acts along a specific direction, for example along a perpendicular direction to the shell.

In an alternative embodiment, the protrusion 22 can comprise a rounded bulge 23, provided at a side surface of the protrusion 22. Preferably the bulge 23 is integral with the protrusion 22.

Figure 14B:
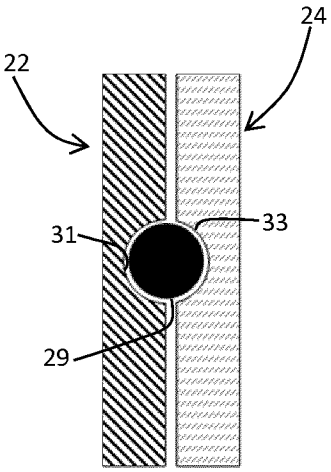
FIGS. 14A and 14B are enlarged views of different embodiments of the particular identified by the letter A in FIG. 14.
Figure 14A:
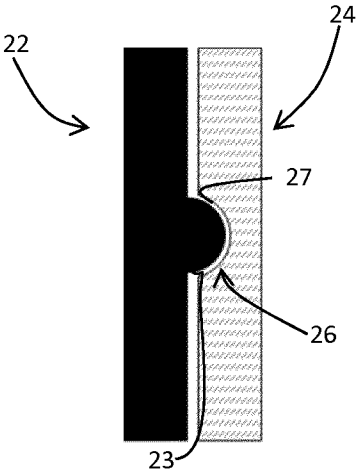

In this case the flexible holding portion 26 of the receiving seat 24 comprises a corresponding groove 27 designed to be engaged by the rounded bulge 23, when the protrusion 22 is fixed inside the receiving seat 24 (see FIG. 14A).

In a further embodiment, the protrusion 22, preferably made with a rigid material, can be provided with a blocking element 29, preferably made with an elastic material, designed to be affixed in a corresponding indentation 31 provided at the side surface of the protrusion 22.

In this case the flexible holding portion 26 of the receiving seat 24 comprises a corresponding groove 33 designed to be engaged by the blocking element 29, when the protrusion 22 is fixed inside the receiving seat 24 (see FIG. 14B).

Also in the embodiments of FIGS. 14A and 14B, the protrusion 22 and the holding portion 26 can have a circular shape. Consequently the bulge 23 and the blocking element 29 form a perimetral ring of the protrusion. Also in these embodiments, the detaching of the visor from the shell can be caused by a force acting along any direction.

Obviously, different arrangements of the bulge 23 and the blocking element 29 are possible, in order to meet other specific needs. For example, the flexible holding portion 26 can be provided with a bulge and a blocking element like those previously disclosed. In this case, the protrusion 22 will be provided with corresponding grooves.

Preferably, the receiving seat 24 is inserted inside the recessed area 28 leaving a perimetral gap. In this way, the flexible arms 26 can bent outwardly to allow the insertion and the removal of the protrusion 22 from the receiving seat 24.

Preferably, as it is shown in the attached figures, the hook shaped distal ends 26*a* of the flexible arms have rounded edges so as to make easier the coupling and decoupling of the protrusion 22 from the corresponding receiving seat 24.

Similarly, the perimetral portion 30 of the protrusion can be rounded. Preferably, as shown in the attached figures, the perimetral portion 30 projects outwardly from a solid leg portion 34 of the protrusion 22.

As above mentioned, in the attached figures, the perimetral portion 30, and as consequence the holding portion 26, has a circular shape.

In this way, the protrusion can rotate inside the corresponding receiving seat around a transversal axis T (see FIGS. 8 and 14). Advantageously, if two protrusions 22 having a perimetral circular portion 30 are positioned at both sides of the visor 14, the latter, thanks to the possible rotation of each protrusion 22 inside its receiving seat, can be adjusted with respect to the outer shell 12, even if it is firmly connected therein.

Obviously, different shapes of the protrusion 22, and as a consequence of the receiving seat 24, are possible, in order to meet other specific needs. For example, the protrusion 22 can have an oval or triangular cross section.

Advantageously, when the protrusion 22 of the visor 14 is engaging the corresponding receiving seat 24 provided on the outer shell 12, the inner surface of the visor abuts against an adjacent surface of the shell, allowing the visor to stay adherent to the shell.

According to the embodiment of FIG. 2, the outer shell 12 can have a recessed area 36 shaped to complement a perimetric portion of the visor 14, so as to allow the visor 14 to be coupled flush with the outer shell 12.

Figure 11:
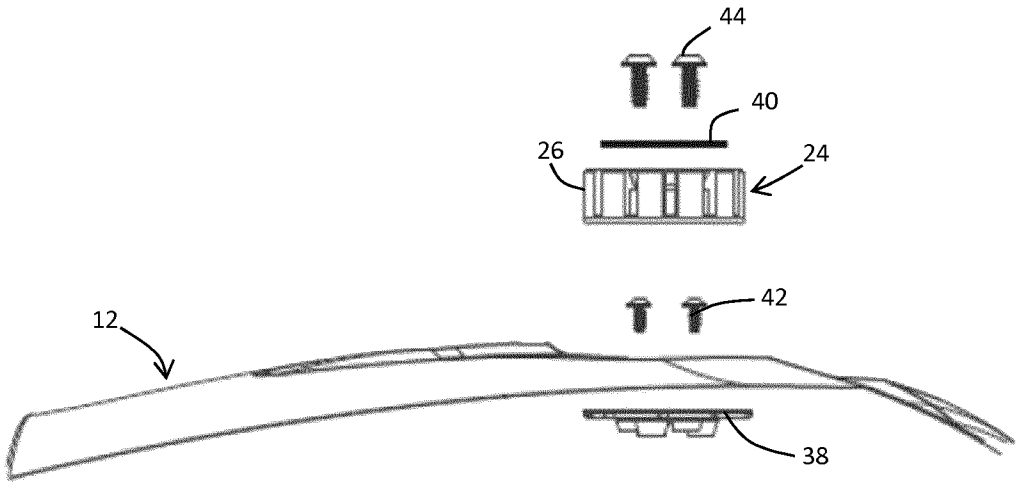
FIG. 11 is a side schematic view of FIG. 10.

With reference to FIGS. 10 and 11, preferably each receiving seat 24 is removably inserted inside the recessed area 28 provided in the outer shell 12, being sandwiched between two rigid fasteners 38, 40.

In detail, a first fastener 38 is removably affixed inside the recessed area 28 by means of first screws 42 designed to engage corresponding seats provided in the first fastener 38.

The bottom surface of the receiving seat 24 is designed to abut against the first fastener 38 and to be blocked therein by means of a second fastener 40 which, by means of second screws 44 engaging corresponding holes of the first fastener 38, is adapted to be connected to the first fastener 38.

This particular arrangement allows an easy replacement of the receiving seat 24 if needed.

Figure 12:
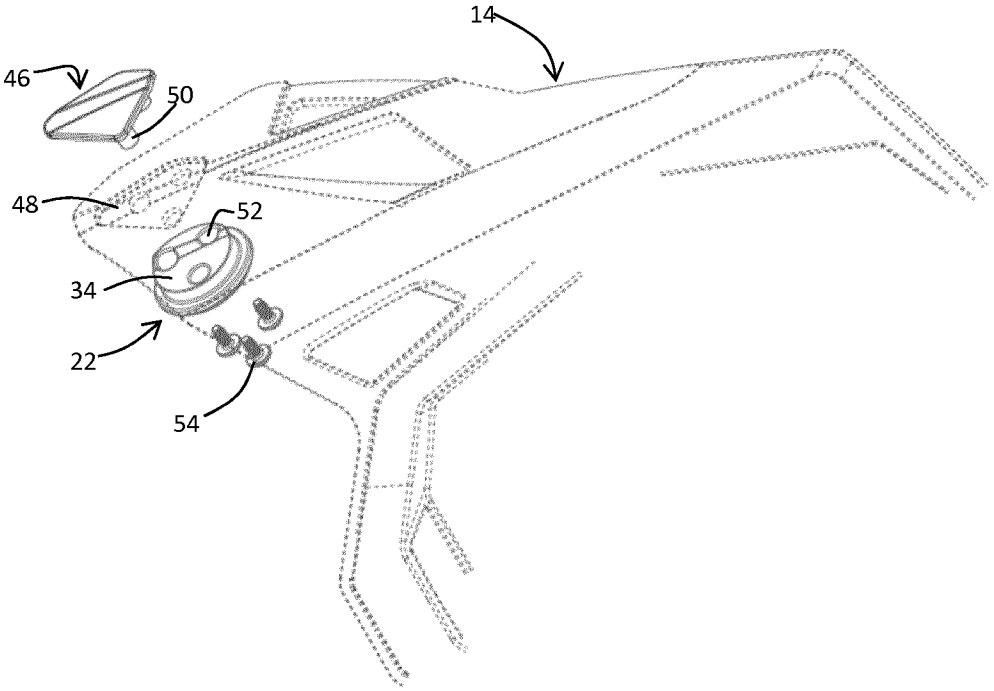
FIG. 12 is a schematic perspective view showing how the complementary fastening element of FIGS. 7, 8 and 9 can be attached to the visor of the helmet of the present invention.
Figure 13:
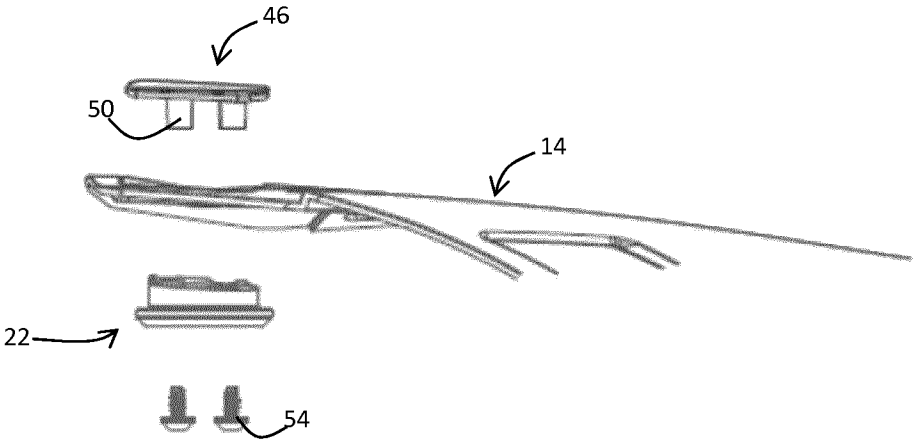
FIG. 13 is a side schematic view of FIG. 12.

With reference to FIGS. 12 and 13, preferably each protrusion 22 is fastened to the inner surface of the visor 14 by means of a clip 46 having a shape complementarily fitting with a corresponding recess 48 provided on the outer surface of the visor 14.

The clip 46 preferably is mounted flush with the outer surface of the visor 14 and is provided with protrusions 50 designed to be inserted inside through holes 52 of the recess 48.

The protrusions 50 can advantageously engage corresponding seats 52 provided in the leg portion 34 of the protrusion 22 to which they are fastened by means of screws 54.

As shown in FIG. 14, once the protrusion 22 is inserted inside the corresponding receiving seat 24, the top surface of the protrusion is designed to abut against the second rigid fastener 40, so as to provide a firmer connection between visor and shell.

Advantageously, the flexible holding portion 26 of the receiving seat 24 is made with elastic polymeric material, preferably thermoplastic polymeric material, like for example TPE (thermoplastic elastomer), TPEE (thermoplastic polyester elastomer) or TPU (thermoplastic polyurethane).

The elastic polymeric materials, and in particular thermoplastic polymeric materials, combine a high elasticity with a high resistance and good resistance to impact. Moreover the use of thermoplastic polymeric materials, in particular of TPE, TPEE and TPU, assures a uniform behavior of the holding portion 26 across a wide range of temperature (from −30° C. to +70° C.).

Preferably a holding portion 26 made with an elastic polymeric material has a hardness comprised between 58 and 68 shore D.

The holding portion 26 made with an elastic polymeric material undergoes a temporary deformation of its shape when the protrusion is inserted therein. This deformation is self-reversing when the protrusion is extracted from the receiving seat 24 or inserted therein again.

Alternatively, the flexible holding portion 26 of the receiving seat can be made with rigid polymeric material, like for example nylon or acetalic polymer.

In this case, the holding portion 26 has a hardness comprised between 80 and 100 shore D.

In this case, the holding portion 26 is not elastic and is made flexible by properly shaping the arms. In particular, the arms might be designed to be relatively longer and slender with respect to the case in which they are manufactured using an elastic material.

This shape allows the arms to be bended, for allowing the insertion of the protrusion 22, even if they do not undergo any deformation in shape.

Preferably the protrusions 22 are made with rigid polymeric material like for example nylon or acetalic polymer.

Figure 15:
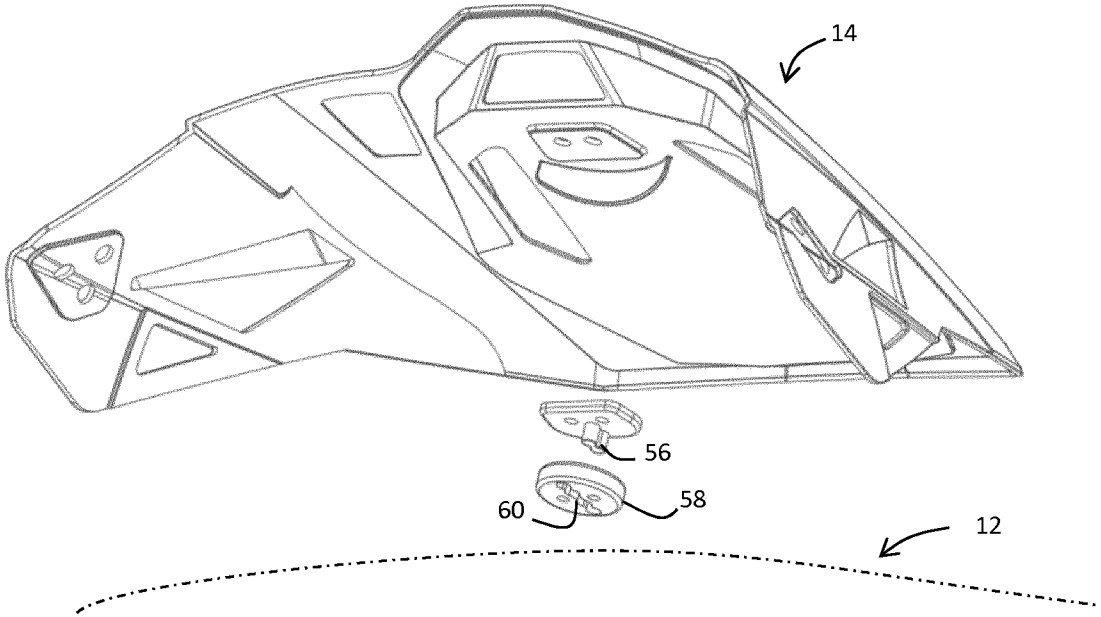
FIG. 15 shows a detail of a fastening element of the visor of the helmet according to the invention.

With reference to FIG. 15, according to an embodiment of the invention, a fastener pin 56 is positioned along a midline of the inner surface of the visor 14 and a receiving seat 58 is positioned at a corresponding location of the outer shell 12.

The receiving seat 58 is advantageously provided with a central slot 60 designed to be engaged by the fastener pin 56.

Figures 16A, 16B, 16C:
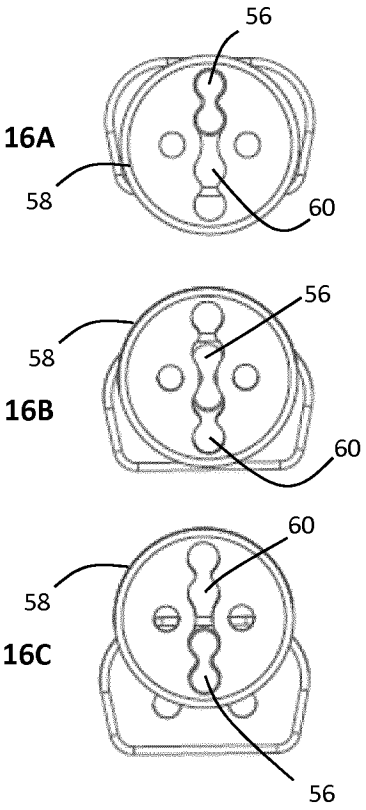
FIGS. 16A, 16B and 16C show possible adjustments of the fastening element of FIG. 15.

Preferably, the central slot 60 is contoured so that the fastener pin 56 can engage the receiving seat 58 in different positions, for example in three different positions (see FIGS. 16A-16C).

In this way, advantageously the visor 14 can be adjusted with respect to the outer shell 12, in particular with respect to a horizontal plane.

For example, by starting from FIG. 16B wherein the fastener pin 56 is engaging the central portion of the slot, by inserting the fastener pin 56 inside the upper portion of the central slot 60, the visor 14 can be positioned in a higher position (see FIG. 16A).

Similarly, by inserting the fastener pin 56 inside the lower portion of the central slot 60, the visor 14 can be positioned in a lower position (see FIG. 16C).

Figure 17:
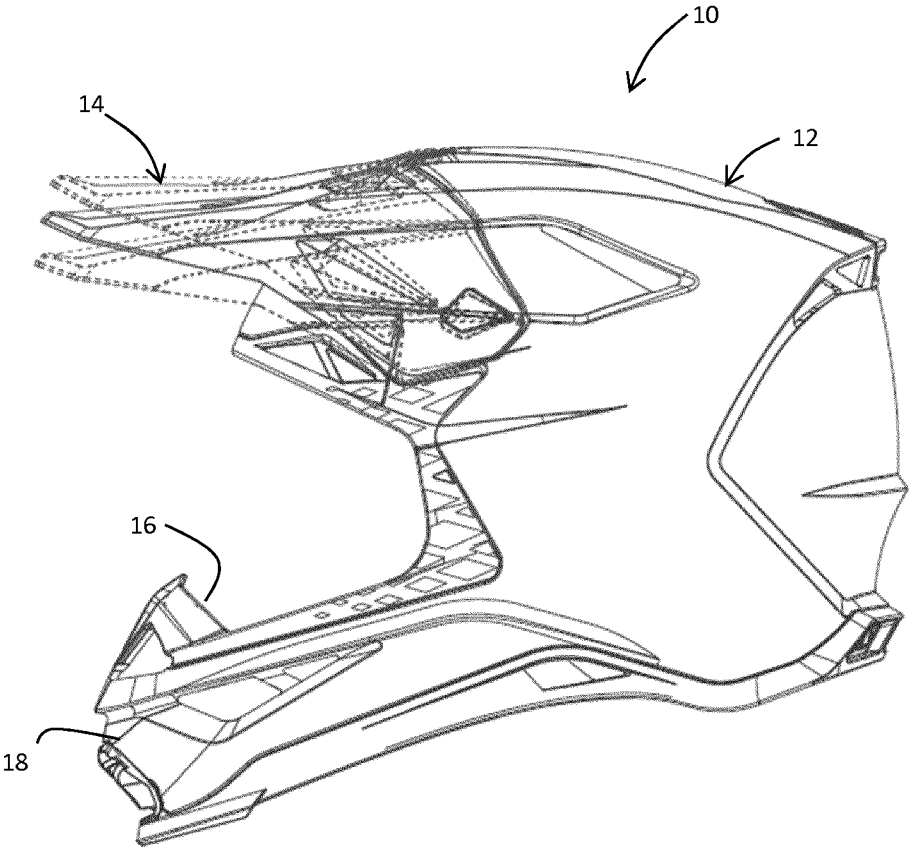
FIG. 17 shows different adjustments of the visor with respect to the shell obtainable by means of the fastening element of FIG. 15.

The raised and lowered positions are depicted by means of broken lines in FIG. 17.

At this point it is clear how the predefined objects may be achieved with the protective helmet 10 according to the invention.

As a matter of fact, the fastening mechanism 20 assures a firmly coupling between the visor 14 and the outer shell 12 during normal use, each protrusion 22 being steadily held by the holding portion of the corresponding receiving seat 24. At the same time, the holding portion 26 being flexible allows an easy detachment of the protrusion 22 from the corresponding receiving seat so as to permit the detachment of the visor from the shell 12 in case of an impact or if it is needed.

Moreover, due to the specific shape of the protrusion and receiving seat, in particular thanks to the specific positioning of the flexible and elastic arms around the protrusion, the detachment between the visor and the shell can take place in presence of an impact force coming from any direction. In other words, the release of the visor from the shell can happen not only when an impact force acts along a plane perpendicular to the surface of the shell, but also in case the impact force is inclined or parallel with respect to the shell.

As a matter of fact, both the components of the impact force, namely the tangential component and the normal component, will be effective in releasing the visor from the shell. In this way a higher protection against dangerous rotations of the helmet in case of impact is assured, without affecting the reliability of the connection between the visor and the helmet during normal use.

Furthermore, the removably fixing of the receiving seat 24 inside the corresponding recessed area 28 allows an easy replacement of the receiving seat, if needed. As a matter of fact, such a replacement can be done by simply removing the screws connecting the first fastener to the second fastener.

Moreover, being the protrusion 22 completely inserted inside the receiving seat 24, the inner surface of the visor can be positioned adherent to the outer surface of the shell, without creating any gap between the two components.

Moreover, if the outer shell is provided with a recessed area shaped according to a perimetric portion of the visor, the latter can be advantageously mounted flush with the outer shell.

Finally, the central slot 60 allows the visor to be easily adjusted with respect to the rider's eyes without affecting the coupling between the visor and the outer shell.

The above advantages have been confirmed by experimental tests carried out by the applicant.

Here below data concerning three different tests are reported.

1st Test: Visor Connectors Strength

In detail, this test concerns the measurement of the impact force needed for detaching the visor from the shell.

Two fastening mechanisms (composed by a circular protrusion and a corresponding receiving seat) have been tested.

The mechanisms differ in the dimensions: in the first one the circular protrusion has a diameter of 27 mm and height of 4 mm and the corresponding receiving seat has a diameter of 32 mm and height of 10.5 mm (hereinafter "big").

In the second one the circular protrusion has a diameter of 17.7 mm and height of 3.9 mm and the corresponding receiving seat has a diameter of 22 mm and height of 8.5 mm (hereinafter "small").

The receiving seats in both cases are made with TPEE (elastic polymeric material).

The force requested to detach the fastening mechanisms has been measured, by simulating an impact force applied perpendicularly to the fastening mechanisms, but acting 27.5 mm far from the longitudinal axis of the mechanisms.

Results of the test are reported below:

| Fastening mechanism | Detaching force (N) |
|---|---|
| Big | 33.15 |
| Small | 26.36 |

The above data prove that, even if the receiving seat is made with an elastic material, the visor is firmly connected to the shell during the normal use.

2nd Test: Multiple Directions Impact Test

In detail, this test measures the capability of the visor of the helmet of the present invention to detach in case of impact from multiple directions.

Two different helmets (size M) have been tested and compared.

The first helmet is provided with a visor coupled to the shell according to the present invention, in particular by means of circular protrusions and corresponding receiving seats, the latter made with TPEE (hereinafter "detachable visor").

The second helmet is provided with a visor and a shell like the first helmet, but having the visor blocked by means of screws to the shell (hereinafter "fixed visor").

The impact has been simulated by means of a rod falling vertically with a speed of 2.5-2.75 m/s along a specific rig and impacting the visor near the tip.

Two types of impact have been simulated: an impact from top to bottom (hereinafter "normal configuration") and an impact from bottom to top (hereinafter "upside down configuration").

An accelerometer was assembled to measure the deceleration of the rod during the impact. The trend of the linear accelerations has been recorded and the "peak of linear acceleration (PLA)" measured; in addition, the trend of the velocities has been calculated and the difference between initial and final velocity (Δv) measured.

The PLA provides an indication about the force acting on the helmet during the impact; lower this value, lower the force on the helmet/head of the rider.

The Δv provides an indication about the energy absorbed by the helmet during the impact; lower this value, lower the energy transmitted to the head of the rider.

Results of the test are reported below:

| | Normal configuration | | | Upside down configuration | | |
|---|---|---|---|---|---|---|
| | Detachable visor | Fixed visor | Diff % | Detachable visor | Fixed visor | Diff % |
| PLA (g) | 11.30 | 19.73 | 74.6% | 15.21 | 26.95 | 77.1% |
| Δv (m/s) | 2.36 | 4.74 | 101.1% | 2.48 | 3.42 | 38.1% |

The above data clearly show that a helmet according to the present invention, provided with a visor able to be easily detached in case of an impact, is suitable to reduce the force and the energy transmitted to the head of the user during an accident.

At the same time, by comparing the above data, it is also confirmed that substantially the same amount of force is needed to detach the visor from the shell, independently from impact direction.

3rd Test: Effect of the Visor During an Impact

As before mentioned the visor has an effect during an impact since it increases the "leverage effect" of the helmet.

The test has been carried out to compare the behaviour of three different helmets (all size M):

a helmet without visor, as usually tested for homologation (1st sample);

a helmet according to the present invention, wherein the visor is attached to the shell by means of receiving seat made with elastic polymeric material (2nd sample);

a helmet identical to the second sample, with the visor fixed to the shell by means of screws (3rd sample).

Tests were carried out at an impact speed of 7.5 m/s, on an oblique anvil.

The helmet with the visor assembled (2nd and 3rd sample) was positioned so that the impact was about 5 cm far from the tip of the visor, the helmet without visor (1st sample) was positioned so that the impact was in frontal area of the shell.

During the impacts, the "peak of linear acceleration (PLA)" and the "peak of rotational accelerations (PRA)" were measured.

Results of the tests are reported below:

| Helmet | PLA (g) | PRA (rad/s$^2$) |
|---|---|---|
| 1st sample (without visor) | — | 3777 |
| 2nd sample (detachable visor) | 85 | 4014 |
| 3rd sample (fixed visor) | 92.5 | 4227 |

The above results clearly prove that the visor has a "leverage effect" during the impact, since the sample without visor has the lowest PRA.

The results also show that the helmet according to the present invention has the additional advantage to reduce this "leverage effect", having lower values of PLA and PRA with respect to the third sample.

With regard to the embodiments of the protective helmet 10 described above, the person skilled in the art may, in order to satisfy specific requirements, make modifications to and/or replace elements described with equivalent elements, without thereby departing from the scope of the accompanying claims.

The invention claimed is:

1. A protective helmet comprising:

an outer shell;

a visor removably coupled at sides of the outer shell by means of two fastening mechanisms positioned on facing surfaces of said outer shell and said visor;

characterized in that each fastening mechanism comprises complementarily shaped elements comprising a single protrusion and a single receiving seat provided in a flexible holding portion;

the single protrusion being adapted to be removably fixed inside the single receiving seat by engaging the flexible holding portion;

wherein the flexible holding portion is formed of elastic polymeric material and wherein the flexible holding portion comprises a plurality of flexible arms having hook shaped distal ends adapted to enclose and hook a perimetral portion of the single protrusion; and wherein the single protrusion and the flexible holding portion have a circular shape, and that the flexible arms form a holding ring for the perimetral portion of the single protrusion of each mechanism.

2. The protective helmet according to claim 1, characterized in that the single protrusion of each fastening mechanism is positioned at inner side ends of the visor and the single receiving seat of each fastening mechanism is positioned at corresponding locations of the outer shell.

3. The protective helmet according to claim 1, characterized in that the single receiving seat of each fastening mechanism is provided on a recessed area of the outer shell;

the single receiving seat being flush with the outer shell.

4. The protective helmet according to claim 1, characterized in that the single receiving seat of each fastening mechanism comprises a hollow body adapted to house the single protrusion of each fastening mechanism when the visor and the outer shell are coupled to each other.

5. The protective helmet according to claim 4, characterized in that flexible arms are provided at a perimetral portion of the hollow body of the receiving seat.

6. The protective helmet according to claim 1, characterized in that the single protrusion comprises a rounded bulge, provided at a side surface of the protrusion;

the flexible holding portion of the receiving seat comprising a corresponding groove configured to be engaged by the rounded bulge, when the protrusion is fixed inside the receiving seat.

7. The protective helmet according to claim 1, characterized in that the protrusion is provided with a blocking element, configured to be affixed in a corresponding indentation provided at the side surface of the protrusion;

the flexible holding portion of the receiving seat comprising a corresponding groove designed to be engaged by the blocking element, when the protrusion is fixed inside the receiving seat.

8. The protective helmet according to claim 1, characterized in that an inner surface of the visor is configured to abut against an adjacent surface of the outer shell, when the protrusion engages the corresponding receiving seat.

9. The protective helmet according to claim 1, characterized in that the hook shaped distal ends have rounded edges.

10. The protective helmet according to claim 1, characterized in that at least one fastener pin is positioned along a midline of an inner surface of the visor and in that at least one receiving seat is positioned at a corresponding location of the outer shell.

11. The protective helmet according to claim 10, characterized in that the at least one receiving seat is provided with at least one central slot configured to be engaged by the at least one fastener pin.

12. The protective helmet according to claim 11, characterized in that the central slot is contoured so that the at least one fastener pin is suitable for engaging the at least one receiving seat in different positions, so as to allow the visor to be adjusted with respect to the outer shell.

13. The protective helmet according to claim 1, characterized in that the single protrusion and the flexible holding portion of each fastening mechanism have a circular shape.

14. The protective helmet according to claim 1, characterized in that the flexible arms form a holding ring for the perimetral portion of the single protrusion of each fastening mechanism.

15. The protective helmet according to claim 1, characterized in that the single receiving seat of each fastening member is removably inserted inside a recessed area of the shell.

16. The protective helmet according to claim 1, characterized in that the flexible arms of the flexible holding portion made of elastic polymeric material are configured to release the protrusion from the receiving seat in an event of impact on the visor independently from the direction along which a releasing force is applied.

17. The protective helmet according to claim 1, characterized in that an entirety of the flexible holding portion is formed of elastic polymeric material.

* * * * *